US006929592B2

(12) United States Patent
Matuschczyk et al.

(10) Patent No.: US 6,929,592 B2
(45) Date of Patent: Aug. 16, 2005

(54) ROLL COVER

(75) Inventors: Uwe Matuschczyk, Geislingen (DE); Hermann Reichert, Oggenhausen (DE)

(73) Assignee: Voith Paper Patent GmbH, Heidenheim (DE)

( * ) Notice: Subject to any disclaimer, the term of this patent is extended or adjusted under 35 U.S.C. 154(b) by 238 days.

(21) Appl. No.: 10/290,340

(22) Filed: Nov. 8, 2002

(65) Prior Publication Data

US 2003/0092548 A1 May 15, 2003

(30) Foreign Application Priority Data

Nov. 15, 2001 (DE) ..... 101 56 146

(51) Int. Cl.[7] ..... F16C 13/00

(52) U.S. Cl. ..... 492/50; 492/30; 492/44; 492/43; 428/371

(58) Field of Search ..... 492/44, 43, 50, 492/56, 30; 428/364, 371

(56) References Cited

U.S. PATENT DOCUMENTS

| | | | | |
|---|---|---|---|---|
| 4,238,287 A | | 12/1980 | Gill | |
| 5,062,924 A | * | 11/1991 | McCarten et al. | 162/358.4 |
| 5,118,391 A | * | 6/1992 | Matuschczyk et al. | 162/358.4 |
| 5,320,702 A | | 6/1994 | Matuschczyk et al. | |
| 5,431,993 A | * | 7/1995 | Metzler | 428/107 |
| 5,813,959 A | * | 9/1998 | Hader et al. | 492/7 |
| 5,943,951 A | * | 8/1999 | Muellner et al. | 100/37 |
| 6,136,151 A | * | 10/2000 | Davenport et al. | 162/306 |
| 6,149,771 A | * | 11/2000 | Matuschczyk | 162/358.4 |
| 6,338,706 B1 | | 1/2002 | Sohl | |

FOREIGN PATENT DOCUMENTS

| | | |
|---|---|---|
| CA | 2161486 | 4/1996 |
| DE | 4022800 | 9/1991 |
| DE | 4115816 | 11/1992 |
| DE | 4411620 | 10/1995 |
| DE | 4438354 | 5/1996 |
| DE | 19703631 | 8/1998 |
| DE | 19723211 | 12/1998 |
| DE | 19914709 | 10/2000 |
| DE | 19928753 | 12/2000 |
| DE | 19952320 | 5/2001 |
| EP | 0363887 | 4/1990 |
| EP | 0882837 | 12/1998 |
| FR | 2455119 | 11/1980 |
| GB | 2287484 | 9/1995 |

* cited by examiner

*Primary Examiner*—Marc Jimenez
(74) *Attorney, Agent, or Firm*—Greenblum & Bernstein, P.L.C.

(57) ABSTRACT

The present invention is directed to a roll cover for a calender or press roll for treating a material web. The roll cover includes a layer of elastomeric material having filaments running approximately longitudinally with respect to a web run direction and transversely to the web run direction embedded for reinforcement, and at least one layer of additional reinforcing filaments embedded in at least some sections of the elastomeric layer. The additional reinforcing filaments run at an angle between 20° and 70° with respect to the web run direction. The layer is arranged to form roll ends connectable to a roll axle. The instant abstract is neither intended to define the invention disclosed in this specification nor intended to limit the scope of the invention in any way.

37 Claims, 1 Drawing Sheet

ROLL COVER

CROSS-REFERENCE TO RELATED APPLICATIONS

The present application claims priority under 35 U.S.C. §119 of German Patent Application No. 101 56 146.6 filed Nov. 15, 2001, the disclosure of which is expressly incorporated by reference herein in its entirety.

BACKGROUND OF THE INVENTION

1. Field of the Invention

The invention relates to a roll cover for a calender or press roll for treating a material web, in particular for dewatering a paper, board, tissue or other fibrous web in a press nip of a machine for producing the fibrous nip, of which the ends are connected to a roll axle and which has a layer of elastomeric material, in which filaments running approximately longitudinally with respect to the web running direction and transversely with respect to the web running direction are embedded for reinforcement.

2. Discussion of Background Information

Roll covers of this type have been known for a long time and are used in particular in shoe press rolls. There, because of the concave pressing area for forming an extended press nip, they are subjected to continual deformation. As the machine speed increases, the result is considerable requirements on the susceptibility to wearing and tearing.

SUMMARY OF THE INVENTION

The present invention improves the stability and wear resistance of the roll cover without substantially impairing its suitability and with a tolerable outlay.

According to the invention, at least in some sections, at least one layer of additional reinforcing filaments is embedded in the layer, the reinforcing filaments running at an angle between 20° and 70° with respect to the web running direction.

Here, it has been recognized that the roll cover is stressed highly when it is driven. Since such calender or press rolls are not driven directly, the drive is provided by a belt belonging to the press nip or the other roll of the calender or press nip. Because of the moment of inertia of the elements for connecting the roll cover to the roll axle, and of the roll axle itself, the roll cover is subjected to a considerable torque during the starting and stopping process and also during operation. The twisting which is produced in the process leads to tearing and increased abrasion. The additional reinforcing filaments running at angle to the direction of rotation are able to absorb these stresses. Since the shear stresses arising from the torque occur at an angle of ±45° to the rotational and web running direction, the additional reinforcing filaments should likewise run at an angle between 35° and 70°, preferably of about 45°, with respect to the web running direction.

The filaments running longitudinally with respect to the web running direction (circumferentially or helically) and transversely with respect to the web running direction (axially) should advantageously form at least a separate layer in each case. Advantages with regards to the feasibility of production result if at least one layer in each case of filaments running longitudinally and transversely with respect to the web running direction is formed by a fabric. In order to influence the torsional rigidity, however, it can also be advantageous if at least two layers of filaments running approximately longitudinally and transversely with respect to the web running direction, as viewed radially, are spaced apart from each other.

Advantages with regard to the flexing behavior result if the distance of the predominant number of the filaments, preferably of all the filaments, running transversely with respect to the web running direction with respect to the outer surface of the roll cover is at least as high as that of the filaments running in the web running direction with respect to the outer surface of the roll cover. In addition, the torsional rigidity can be increased by at least the predominant number of the reinforcing filaments, preferably all the reinforcing filaments, as viewed radially, being arranged between the filaments running in and transversely with respect to the web running direction and the outer surface of the roll cover.

During the starting and stopping operation, the different torques also have the effect of shear stresses in the roll cover, whose directions of action run at right angles to each other. It is therefore advantageous if there are at least two layers of additional reinforcing filaments and at least the additional reinforcing filaments of two layers run at an angle of about 90° with respect to each other.

Advantages in production result if at least two layers of additional reinforcing filaments are formed by a fabric having reinforcing filaments running approximately at right angles to one another. However, it is also possible for at least two layers of additional reinforcing filaments to be formed by a woven, braided or crocheted belt which runs helically in the roll cover, the reinforcing filaments of the layers running approximately at right angles to one another.

Advantages with regard to production and stability result in this case if the belt runs together with the filaments wound spirally and oriented in the web running direction, one edge of the belt being arranged over and the other edge under these filaments. In this case, the edges of the belt should overlap, in particular the edges of the belt should cover the filaments running in the web running direction on both sides.

According to the requirements, the loading and the type of reinforcement, the layers of the additional reinforcing filaments can be arranged outside the filaments running in and transversely with respect to the web running direction and/or between the filaments running in and transversely with respect to the web running direction. The additional reinforcing filaments are preferably embedded between two layers of filaments running in and/or transversely with respect to the web running direction, the filaments and reinforcing filaments preferably exhibiting similar strengths.

It can frequently even be sufficient for the additional reinforcing filaments to be present only in one or more, preferably axially limited, sections of the roll cover. Because of the particularly high stressing, the ends of the roll cover and its center come into question in this case.

In order to keep the stressing of the roll cover as low as possible in the area of the press nips, in particular when forming an extended calender or press nip with a press shoe, and in this way to increase the lifetime, it is advantageous if the roll cover is as soft or as floppy as possible in movement. This can be achieved in particular by the diameter of the reinforcing filaments and/or of the other filaments not exceeding 1 mm.

However, if the roll cover is to be protected comprehensively against overstressing, then the additional reinforcing filaments should also extend over the entire roll cover.

The reinforcing filaments or the corresponding fabric are advantageously wound on during the casting of the roll cover from an elastomeric material.

If the roll cover has grooves running approximately in the circumferential direction to hold water, then it is advantageous if the angle of the reinforcing filaments with respect to the circumferential direction is greater than that of the grooves.

Instead of the grooves or in addition thereto, the roll cover can also have blind holes to hold water.

The present invention is directed to a roll cover for a calender or press roll for treating a material web. The roll cover includes a layer of elastomeric material having filaments running approximately longitudinally with respect to a web run direction and transversely to the web run direction embedded for reinforcement, and at least one layer of additional reinforcing filaments embedded in at least some sections of the elastomeric layer. The additional reinforcing filaments run at an angle between 20° and 70° with respect to the web run direction. The layer is arranged to form roll ends connectable to a roll axle.

In accordance with a feature of the invention, the material web can include one of a paper, board, or tissue web.

According to another feature of the present invention, the roll cover is structured and arranged to form a press nip for dewatering the material web.

The filaments running approximately longitudinally to the web run direction and the filaments running transversely to the web run direction may each be arranged to form at least one layer.

Moreover, the filaments running approximately longitudinally to the web run direction and the filaments running transversely to the web run direction can be arranged to form separate layers. At least one layer of filaments running approximately longitudinally to the web run direction and at least one layer of filaments running transversely to the web run direction may be formed by fabric. The at least one layer of filaments running approximately longitudinally to the web run direction and the at least one layer of filaments running transversely to the web run direction may be located at radially spaced positions.

A distance of a predominant number of the filaments running transversely to the web run direction to an outer surface of the roll cover can be at least as great as a distance of the filaments running approximately longitudinally in the web running direction to the outer surface of the roll cover. Further, a distance of all of the filaments running transversely to the web run direction to the outer surface of the roll cover can be at least as great as the distance of the filaments running approximately longitudinally in the web running direction to the outer surface of the roll cover.

At least a predominant number of the additional reinforcing filaments can be arranged radially between the filaments and the outer surface of the roll cover. Further, all of the additional reinforcing filaments may be arranged radially between the filaments and the outer surface of the roll cover.

According to the invention, the additional reinforcing filaments may be arranged to run at an angle between 35° and 70° to the web run direction. Further, the additional reinforcing filaments can be arranged to run at an angle of about 45° to the web run direction.

Still further, the at least one layer of additional reinforcing filaments can include at least two layers of additional filaments in which the additional filaments in one of the at least two layers of additional filaments are oriented at an angle of about 90° to the additional filaments in another of the at least two layers of additional filaments. The at least two layers of additional filaments can be formed by fabric having reinforcing filaments oriented approximately at right angles to one another. The at least two layers of additional filaments may be formed by one of a woven, braided or crocheted belt in which the reinforcing elements are oriented at approximately right angles to one another. The can be arranged to run helically in the roll cover. Further, the filaments running approximately in the longitudinal direction may be helically wound and the belt is arranged to be helically wound with the helically wound filaments. The belt can be arranged such that one edge of the belt is positioned over the helically wound filaments and an other edge of the belt is positioned under the helically wound filaments. Further still, the edges of the belt may overlap each other, and the edges of the belt can cover both sides of the helically wound filaments. Moreover, the belt is arranged such that an edge of the belt is positioned to overlap an other edge of the belt from a previous pass, and the helically wound filaments can be arranged between the overlapping edges.

According to a further feature of the instant invention, the at least one layer of additional reinforcing filaments may be positioned radially outside the filaments running approximately longitudinally to and transversely to the web run direction.

The at least one layer of additional reinforcing filaments can be arranged between two layers of filaments running at least one of approximately longitudinally to and transversely to the web run direction.

Further, the additional reinforcing filaments can be located in only one section of the roll cover, and the only one section is an axially limited section. Alternatively, the additional reinforcing filaments can be located in a plurality of sections of the roll cover, and each of the plurality of section may be an axially limited section. Further, the additional reinforcing filaments can be arranged to extend over an entirety of the roll cover.

In accordance with still another feature of the present invention, the roll cover can further include grooves arranged to run approximately in a circumferential direction on an outer surface. An angle at which the additional reinforcing filaments can be oriented to the web run direction is greater than an angle at which the grooves are arranged.

The present invention is directed to a roll cover for a calender or press roll for treating a material web. The roll cover includes an elastomeric material layer, arranged to form a roll, and includes first filaments arranged to run one of helically and circumferentially and second filaments arranged to run axially, such that the first and second filaments are embedded in the elastomeric material layer for reinforcement. At least one layer of third reinforcing filaments is embedded in at least some sections of the elastomeric layer, such that the third reinforcing filaments running at an angle between 20° and 70° to a circumferential direction.

According to a feature of the present invention, the first and second filaments can be arranged in separate layers.

In accordance with a further feature of the invention, the first and second filaments can be arranged in radially separate layers.

According to still another feature, the third reinforcing filaments may be arranged to run at an angle of about 45° to the circumferential direction.

The third reinforcing filaments may be arranged in at least two layers of third reinforcing filaments in which the third reinforcing filaments are oriented at about 90° to each other. Further, the at least two layers of third reinforcing filaments may be formed by fabric and/or the at least two layers of third reinforcing filaments may be formed by one of a woven, braided or crocheted belt. The belt can be arranged to run helically in the roll cover, and the belt may be arranged such that an edge of the belt is positioned to overlap an other edge of the belt from a previous pass. Further, the helically wound filaments may be arranged between the overlapping edges.

According another feature of the instant invention, the at least one layer of additional reinforcing filaments can be positioned radially outside the filaments running approximately longitudinally to and transversely to the web run direction.

In accordance with still yet another feature of the present invention, the roll cover can further include grooves arranged to running approximately in a circumferential direction on an outer surface, and an angle at which the additional reinforcing filaments are oriented to the web run direction is greater than an angle at which the grooves are arranged. Alternatively, the roll cover may include at least one of grooves arranged to running approximately in a circumferential direction and blind bores on an outer surface of the roll cover.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, by reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Figure 1:
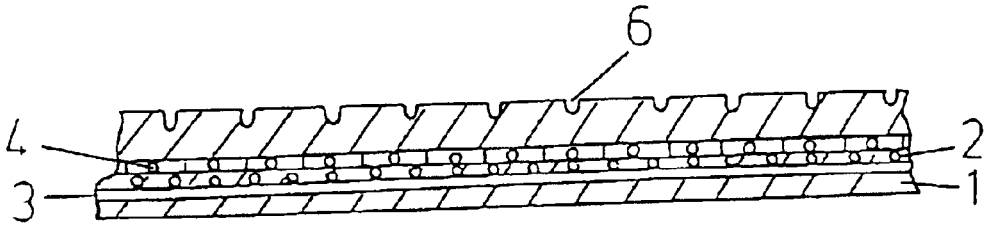
FIG. 1 shows a schematic cross section of the roll cover.

As can be seen in FIG. 1, the roll cover is substantially formed by a layer 1 of elastomeric material, for example polyurethane, in which a layer of filaments 2 running approximately in the web running (circumferential or helical) direction 5 and filaments 3 running transversely thereto (axially) is embedded. These filaments 2, 3 supply the roll cover with the necessary dimensional stability, without impairing the ability to be deformed in the area of the press nip. On the outside, the roll cover has, for example, grooves 6 running approximately in the web running direction 5 to hold the water pressed out.

The roll cover is driven by the opposite cylindrical press roll belonging to the press nip. Since the roll cover is rotatably mounted on the roll axle at the ends via side plates, the generally metallic side plates also have to be accelerated or braked by the roll cover. This torque produces shear stresses in the roll cover, whose direction of action runs at ±45° to the web running direction 5.

Figure 2:
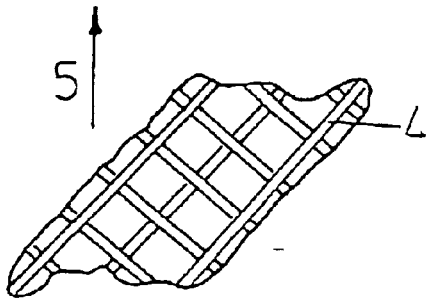
FIG. 2 shows a partial section of the roll cover.

In order to increase the torsional rigidity of the roll cover, the layer 1 also contains two additional reinforcing filaments 4 running at right angles to each other and in each case at 45° to the web running direction 5, according to FIG. 2. These reinforcing filaments 4 are constructed in exactly the same way as the other filaments 2, 3. In the interests of simple production feasibility and high torsional rigidity, the reinforcing filaments 4 are arranged over the other filaments 2, 3, i.e., (radially) outside the latter.

The improved torsional rigidity has a positive effect on the wear and in particular on the abrasion.

Figure 3:
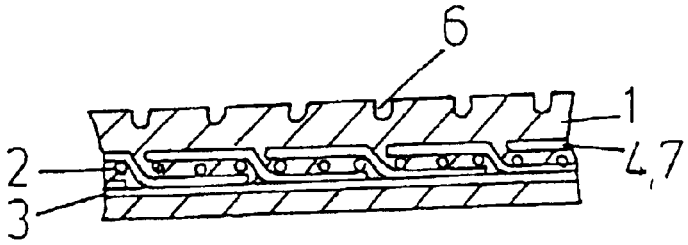
FIG. 3 shows a schematic cross section of the roll cover with belts 7.

FIG. 3 shows a roll cover in which the reinforcing filaments 4 running at right angles to one another are formed by a woven belt, which runs helically in the roll cover together with the filaments 2 oriented in the web running direction 5. In this case, the edges of the belt 7 overlap in such a way that the filaments 2 running in the web running direction 5 are covered on both sides by the belt 7. The belt 7 has a width between 5 and 50 mm, the reinforcing filaments 4 running at an angle to the winding direction and preferably forming the same magnitude of angle with respect to the winding direction.

It is noted that the foregoing examples have been provided merely for the purpose of explanation and are in no way to be construed as limiting of the present invention. While the present invention has been described with reference to an exemplary embodiment, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

What is claimed:

1. A roll cover for a calender or press roll for treating a material web, comprising:

a layer of elastomeric material having filaments running approximately longitudinally with respect to a web run direction and transversely to the web run direction embedded for reinforcement;

at least one layer of additional reinforcing filaments embedded in at least some sections of said elastomeric layer, said additional reinforcing filaments running at an angle between 20° and 70° with respect to the web run direction;

roll ends connectable to a roll axle;

said at least one layer of additional reinforcing filaments comprises at least two layers of additional filaments in which said additional filaments in one of said at least two layers of additional filaments are oriented at an angle of about 90° to said additional filaments in another of said at least two layers of additional filaments;

said at least two layers of additional filaments are formed by one of a woven, braided or crocheted belt in which reinforcing elements are oriented at approximately right angles to one another;

said belt is arranged to run helically in said roll cover; and said filaments running approximately in the longitudinal direction are helically wound and said belt is arranged to be helically wound with said helically wound filaments, wherein said belt is arranged such that one edge of the belt is positioned over said helically wound filaments and an other edge of said belt is positioned under said helically wound filaments.

2. The roll cover in accordance with claim 1, wherein the material web comprises one of a paper, board, or tissue web.

3. The roll cover in accordance with claim 1, wherein said roll cover is structured and arranged to form a press nip for dewatering the material web.

4. The roll cover in accordance with claim 1, wherein said filaments running approximately longitudinally to the web run direction and said filaments running transversely to the web run direction are each arranged to form at least one layer.

5. The roll cover in accordance with claim 1, wherein said filaments running approximately longitudinally to the web run direction and said filaments running transversely to the web run direction are arranged to form separate layers.

6. The roll cover in accordance with claim 5, wherein at least one layer of filaments running approximately longitudinally to the web run direction and at least one layer of filaments running transversely to the web run direction are fabric.

7. The roll cover in accordance with claim 5, wherein said at least one layer of filaments running approximately longitudinally to the web run direction and said at least one layer of filaments running transversely to the web run direction are located at radially spaced positions.

8. The roll cover in accordance with claim 1, wherein a distance of a predominant number of said filaments running transversely to the web run direction to an outer surface of said roll cover is at least as great as a distance of said filaments running approximately longitudinally in the web running direction to said outer surface of said roll cover.

9. The roll cover in accordance with claim 8, wherein a distance of all of said filaments running transversely to the web run direction to said outer surface of said roll cover is at least as great as the distance of said filaments running approximately longitudinally in the web running direction to said outer surface of said roll cover.

10. The roll cover in accordance with claim 1, wherein at least a predominant number of said additional reinforcing filaments are arranged radially between said filaments and said outer surface of the roll cover.

11. The roll cover in accordance with claim 10, wherein all of said additional reinforcing filaments are arranged radially between said filaments and said outer surface of the roll cover.

12. The roll cover in accordance with claim 1, wherein said additional reinforcing filaments are arranged to run at an angle between 35° and 70° to the web run direction.

13. The roll cover in accordance with claim 12, wherein said additional reinforcing filaments are arranged to run at an angle of about 45° to the web run direction.

14. The roll cover in accordance with claim 1, wherein said at least two layers of additional filaments are formed by fabric having reinforcing filaments oriented approximately at right angles to one another.

15. The roll cover in accordance with claim 1, wherein said edges of said belt overlap each other.

16. The roll cover in accordance with claim 15, wherein said edges of said belt cover both sides of said helically wound filaments.

17. The roll cover in accordance with claim 1, wherein said at least one layer of additional reinforcing filaments is positioned radially outside said filaments running approximately longitudinally to and transversely to the web run direction.

18. The roll cover in accordance with claim 1, wherein said at least one layer of additional reinforcing filaments is arranged between two layers of filaments running at least one of approximately longitudinally to and transversely to the web run direction.

19. The roll cover in accordance with claim 1, wherein said additional reinforcing filaments are located in only one section of said roll cover.

20. The roll cover in accordance with claim 19, wherein said only one section is an axially limited section.

21. The roll cover in accordance with claim 1, wherein said additional reinforcing filaments are located in a plurality of sections of said roll cover.

22. The roll cover in accordance with claim 21, wherein each of said plurality of section is an axially limited section.

23. The roll cover in accordance with claim 1, wherein said additional reinforcing filaments are arranged to extend over an entirety of said roll cover.

24. The roll cover in accordance with claim 1, further comprising grooves arranged to running approximately in a circumferential direction on an outer surface.

25. The roll cover in accordance with claim 24, wherein an angle at which said additional reinforcing filaments are oriented to the web run direction is greater than an angle at which said grooves are arranged.

26. A roll cover for a calender or press roll for treating a material web, comprising:

a layer of elastomeric material having filaments running approximately longitudinally with respect to a web run direction and transversely to the web run direction embedded for reinforcement;

at least one layer of additional reinforcing filaments embedded in at least some sections of said elastomeric layer, said additional reinforcing filaments running at an angle between 20° and 70° with respect to the web run direction;

roll ends connectable to a roll axle;

said at least one layer of additional reinforcing filaments comprises at least two layers of additional filaments in which said additional filaments in one of said at least two layers of additional filaments are oriented at an angle of about 90 to said additional filaments in another of said at least two layers of additional filaments;

said at least two layers of additional filaments are formed by one of a woven, braided or crocheted belt in which reinforcing elements are oriented at approximately right angles to one another;

said belt is arranged to run helically in said roll cover; and said filaments running approximately in the longitudinal direction are helically wound and said belt is arranged to be helically wound with said helically wound filaments, wherein said belt is arranged such that an edge of said belt is positioned to overlap an other edge of said belt from a previous pass.

27. The roll cover in accordance with claim 26, wherein said helically wound filaments are arranged between the overlapping edges.

28. A roll cover for a calender or press roll for treating a material web, comprising:

an elastomeric material layer, arranged to form a roll, including first filaments arranged to run one of helically and circumferentially and second filaments arranged to run axially, said first and second filaments being embedded in said elastomeric material layer for reinforcement;

at least one layer of third reinforcing filaments embedded in at least some sections of said elastomeric layer, said third reinforcing filaments running at an angle between 20° and 70° to a circumferential direction;

said third reinforcing filaments are arranged in at least two layers of third reinforcing filaments in which said third reinforcing filaments are oriented at about 90° to each other;

said at least two layers of third reinforcing filaments are formed by one of a woven, braided or crocheted belt; and said belt is arranged to run helically in said roll cover, wherein said belt is arranged such that an edge of said belt is positioned to overlap an other edge of said belt from a previous pass.

29. The roll cover in accordance with claim 28, wherein said first and second filaments being arranged in separate layers.

30. The roll cover in accordance with claim 28, wherein said first and second filaments are arranged in radially separate layers.

31. The roll cover in accordance with claim 28, wherein said third reinforcing filaments are arranged to run at an angle of about 45° to the circumferential direction.

32. The roll cover in accordance with claim 28, wherein said at least two layers of third reinforcing filaments are formed by fabric.

33. The roll cover in accordance with claim 28, wherein said helically wound filaments are arranged between the overlapping edges.

34. The roll cover in accordance with claim 28, wherein said at least one layer of additional reinforcing filaments is positioned radially outside said filaments running approximately longitudinally to and transversely to the web run direction.

35. The roll cover in accordance with claim 28, further comprising grooves arranged to running approximately in a circumferential direction on an outer surface.

36. The roll cover in accordance with claim 35, wherein an angle at which said additional reinforcing filaments are oriented to the web run direction is greater than an angle at which said grooves are arranged.

37. The roll cover in accordance with claim 35, further comprising at least one of grooves arranged to running approximately in a circumferential direction and blind bores on an outer surface of said roll cover.

* * * * *